US006474415B1

(12) United States Patent
Ohmer

(10) Patent No.: US 6,474,415 B1
(45) Date of Patent: Nov. 5, 2002

(54) METHOD AND APPARATUS FOR MILLING OPENINGS IN DOWNHOLE STRUCTURES

(75) Inventor: Herve Ohmer, Houston, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 22 days.

(21) Appl. No.: 09/713,048

(22) Filed: Nov. 15, 2000

(51) Int. Cl.[7] ..... E21B 7/08
(52) U.S. Cl. ..... 166/297; 166/117.5
(58) Field of Search ..... 166/117.5, 117.6, 166/297, 298, 381

(56) References Cited

U.S. PATENT DOCUMENTS

| | | | | | |
|---|---|---|---|---|---|
| 2,716,540 | A | * | 8/1955 | McCune et al. | 166/117.6 |
| 2,839,270 | A | * | 6/1958 | McCune et al. | 166/117.6 |
| 2,882,015 | A | * | 4/1959 | Beck | 166/117.6 |
| 4,640,353 | A | * | 2/1987 | Schuh | 166/248 |
| 4,648,454 | A | | 3/1987 | Yarnell | |
| 4,811,798 | A | | 3/1989 | Falgout, Sr. et al. | |
| 4,895,214 | A | | 1/1990 | Schoeffler | |
| 4,928,767 | A | * | 5/1990 | Jelsma | 166/377 |
| 5,009,273 | A | | 4/1991 | Grabinski | |
| 5,103,921 | A | | 4/1992 | Zeer et al. | |
| 5,579,829 | A | * | 12/1996 | Comeau et al. | 166/117.6 |
| 5,960,882 | A | | 10/1999 | Polivka | |

* cited by examiner

*Primary Examiner*—Frank S. Tsay
(74) *Attorney, Agent, or Firm*—Dan C. Hu; Jeffrey E. Griffin; Brigitte L. Jeffrey

(57) ABSTRACT

A whipstock-less milling apparatus and method for use in a wellbore having a first structure (e.g., a tubular structure such as a casing, liner, or other tubular structure) includes a support element, at least one mill supported by the support element, and a deflection apparatus to deflect the at least one mill to engage the first structure to form an opening in the first structure. In one example, the opening is a window cut through a casing or liner to allow a change in the trajectory of the wellbore or to form a lateral branch from the wellbore in a multilateral well. In another example, one or more axial slots can be formed in the casing or liner to enable propagation of electromagnetic (EM) waves through the slotted casing or liner to measure characteristics of the surrounding formation. In yet a further example, sensors, gauges, and other measurement devices may be placed in a window or outside pocket formed by the whipstock-less milling apparatus. Deflection of the at least one mill is controlled by a deflecting actuator unit activated in response to rotation of a rotatable shaft. The rotation of the rotatable shaft also causes rotation of the at least one mill. When the at least one mill is deflected to engage the first structure, it cuts the opening into the first structure. While the at least one mill is still rotating, longitudinal displacement of the at least one mill is controlled by a feed actuator unit to form an opening having a desired length.

38 Claims, 10 Drawing Sheets

METHOD AND APPARATUS FOR MILLING OPENINGS IN DOWNHOLE STRUCTURES

BACKGROUND

The invention relates to methods and apparatus for milling openings in downhole structures in a wellbore.

To produce hydrocarbons from an underground formation or to inject fluids into an underground formation, wellbores are drilled through the earth subsurface to the desired formation. Such wellbores may be vertical, deviated, or horizontal wellbores. Wells may also be multilateral wells, which have multiple lateral branches that extend from a parent wellbore (also referred to as the main bore).

After a wellbore has been drilled into the earth subsurface, it is typically lined with casing or another type of liner. Casing extends from the well surface some distance into the wellbore. In some wells, liners are also used to line other portions of a wellbore.

In some cases, it may be desirable to change the trajectory of a wellbore after the wellbore has been drilled and the casing or liner has been cemented in the wellbore. The change in trajectory may be desired to reach better producing zones of a formation. Further, lateral branches may be extended from a cased or lined main bore to provide a multilateral well.

To change the trajectory of the wellbore or to add a lateral branch, windows are formed in the casing or liner to enable drilling of the lateral bore. The casing or liner window is generally cut by a milling assembly having one or more mills. The peripheral surfaces of the mills are generally covered with abrasive or cutting inserts made of a hard material, such as sintered tungsten carbide compounds braised on a steel mandrel. The mills are designed to cut through a steel casing or liner. A deflection tool, referred to as a whipstock, is generally set in the wellbore before the milling assembly is run into the wellbore. The whipstock is located in the proximity of the region in which the lateral bore is to begin. The whipstock provides a slanted surface that guides the mills of the milling assembly into the adjacent casing or liner. The whipstock pushes the milling assembly towards the casing or liner wall under action of a downward force on the milling assembly.

Although a whipstock is expected to support some milling damage, it may be difficult to predict how much whipstock material is left after milling has been performed. In addition, after milling operations have been completed, it may be difficult to retrieve the damaged whipstock, which can lead to a major obstruction of the well and subsequent abandonment of the section of the well below the whipstock. In addition, conventional milling assemblies may not provide adequate control of the window geometry. Further, using whipstocks for milling operations is also a time-consuming task since the whipstock is set in the wellbore ahead of the milling assembly, and after milling has been performed, the whipstock is retrieved.

Difficulties may also arise when using whipstocks in subsea milling operations. In subsea applications, a milling assembly is typically run from a sea vessel through a marine riser to wellhead equipment at the sea floor. The milling assembly is lowered into the subsea wellbore through the wellhead equipment and run to an interval where a whipstock is located. Unlike land wells, however, stability of the milling assembly is an issue due to up and down movement of the vessel. Such vertical movement may cause substantial damage to the milling assembly or to the whipstock that prevents further milling operations. One conventional solution is to employ a feeder control mechanism in the well head equipment to limit vertical movement of the milling assembly, which m ay occur due to motion of the sea vessel. However, this adds to the complexity of the wellhead equipment, which increases costs and reduces reliability.

A need thus exists for an improved method and apparatus for milling windows or other openings in well casings or liners or other downhole structures.

SUMMARY

In general, according to one embodiment, a milling string for use in a wellbore having a first structure comprises a support assembly having a first end and a second end, at least one mill supported by the support assembly between the first and second ends, and a deflection apparatus attached to the support assembly to deflect the at least one mill to engage the first structure to form an opening in the structure.

Other features and embodiments will become apparent from the following description, from the drawings, and from the claims.

DETAILED DESCRIPTION

Figure 1:
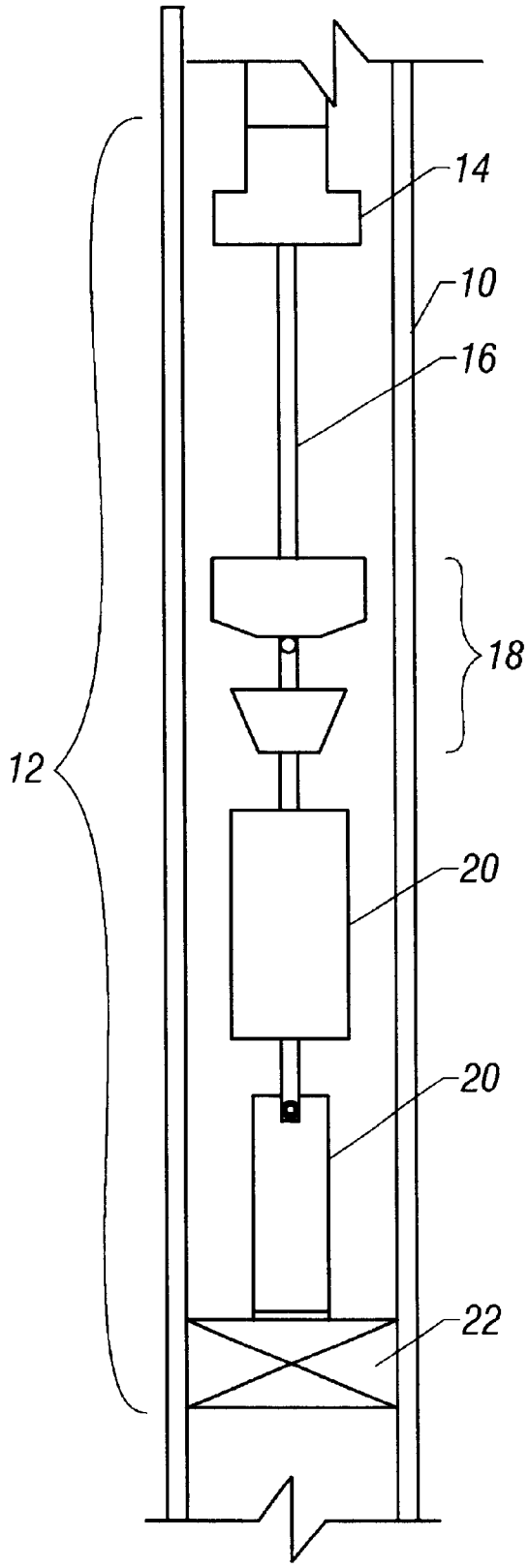
FIG. 1 illustrates an embodiment of a milling tool.

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

In accordance with some embodiments of the invention, a whipstock-less milling tool is employed for milling windows in casings or liners to change the trajectory of a wellbore or to form lateral bores extending from a main bore. As used below, the term "liner" refers to either a casing or a liner. In addition, in other embodiments, the milling tool is capable of milling openings in downhole structures other than liners. Such other downhole structures may include tubings, pipes, or any other conduit that can be positioned in a wellbore. The downhole structures can be either tubular or non-tubular structures. Thus, generally, a downhole structure refers to casings, liners, pipes, tubings, and any other structures positioned in a wellbore.

By using a whipstock-less milling tool, the various limitations associated with a milling whipstock are avoided. For example, damage to a whipstock during milling operations and resulting difficulties associated with such damage may be avoided, which saves time and cost. By not using a milling whipstock, setting and retrieval of the whipstock is avoided. The whipstock-less milling tool in accordance with some embodiments is capable of being used in high inclination and deep intervention wells. In addition, some embodiments allow through-tubing access, unlike conventional milling assemblies that require the full inner diameter of the liner. Also, for subsea applications, damage due to interaction between a milling tool and a milling whipstock resulting from the up-and-down motion of a sea vessel can be avoided. Thus, generally, flexibility and convenience is enhanced by using a whipstock-less milling tool.

In other applications, the whipstock-less milling tool can be used to form one or more axial slots along the liner to enable a monitoring tool positioned inside the liner to take measurements of the formation surrounding the liner. The monitoring tool inside the liner generates electromagnetic (EM) waves that are propagated through the axial slots for measuring characteristics of the surrounding formation. The EM radiation is propagated in a mode known as a transfer electric (TE) mode.

After a liner has been set in a wellbore, measurements of a portion of a downhole formation may be desired. For example, over time, one or more formation zones may become depleted or may start taking water. Identification of another zone may thus be desirable. To do so, a whipstock-less milling tool according to some embodiments is lowered to the desired depth, where the axial slots are formed with the milling tool. After the axial slots have been formed, the milling tool is retrieved and a monitoring tool run into the wellbore to a location proximal the axial slots to take measurements.

In yet a further application, the window formed in the liner with a whipstock-less milling tool provides a side pocket in which various types of monitoring and control devices (including sensors and gauges) may be placed. The whipstock-less milling tool enables the cutting of an opening with the desired location and geometry so that placement of the devices in the opening is made possible.

Referring to FIG. 1, in accordance with one embodiment, a whipstock-less milling tool 12 (carried on a drill string, coiled tubing, wireline, or other mechanism not shown) is positioned in a wellbore lined with a liner 10. The whipstock-less milling tool 12 includes a motor 14 (such as a positive displacement motor) that is connected to an articulated assembly 16 that supports a mill mechanism 18 having one or more mills. The milling tool 12 also includes a deflecting and feed control unit 20, as well as a landing and latching device 22 to help secure the tool 12 at a predetermined location in the wellbore. The landing and latching device 22 is one embodiment of a support member to maintain an axial or longitudinal position of a portion of the milling tool. For example, the landing and latching device 22 may include an anchor.

The mill mechanism 18 is placed between the two ends of a support assembly (including various components in the milling tool 12 for supporting the mill mechanism 18). The lower end of the support assembly is engaged to the landing and latching device 22, and the upper end of the support assembly is connected to the motor 14. The mill mechanism 18 is placed between the two ends of the support assembly so that deflection of the support assembly allows the mill mechanism 18 to move radially to engage a downhole structure.

After the milling tool 12 is run to a desired depth, the motor 14 is activated to start rotation of a rotatable shaft in the articulated assembly 16. Revolution of the shaft causes portions of the milling tool 12 to deflect so that the mill mechanism 18 contacts an inner surface of the liner 10. In one embodiment, after deflection of portions of the milling tool 12, longitudinal movement (downwardly or upwardly) of the one or more mills 18 by the deflecting and feed control unit 20 causes formation of a desired opening or window in the liner 10.

In an alternative embodiment, the motor 14 may be replaced with a fluid turbine or other downhole rotary power generator. Instead of a downhole motor or generator, the milling tool 12 may also be driven from the well surface by conventional rotary drilling machinery. Another option is to combine downhole and surface rotary power generation.

The landing and latching device 22 may include landing and orienting keys (not shown) to secure the tool 12 at a predetermined location and orientation in the wellbore. The keys of the landing and latching device 22 mate with a corresponding landing profile part of the liner 10 or in a special indexing packer (not shown). The landing and latching device 22 may be set by applying weight on the milling tool 12 that triggers a latching mechanism. The latching mechanism may be released by an upward pull of the entire milling tool 12.

Figure 2D:
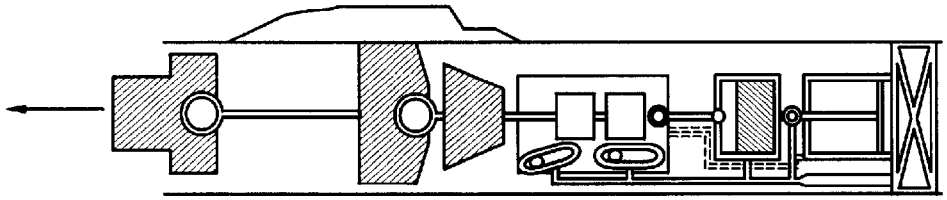
FIGS. 2A–2D illustrate operation of the milling tool of FIG. 1, in accordance with one embodiment.
Figure 2C:
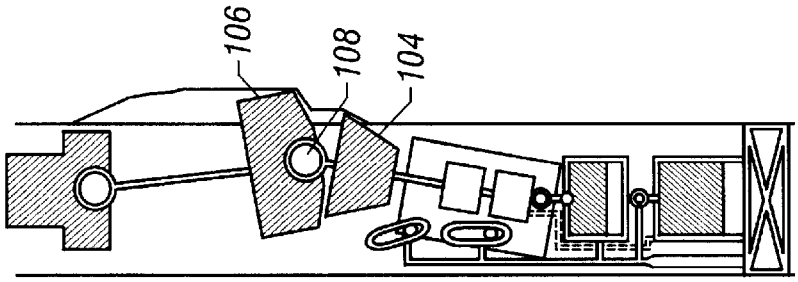
Figure 2B:
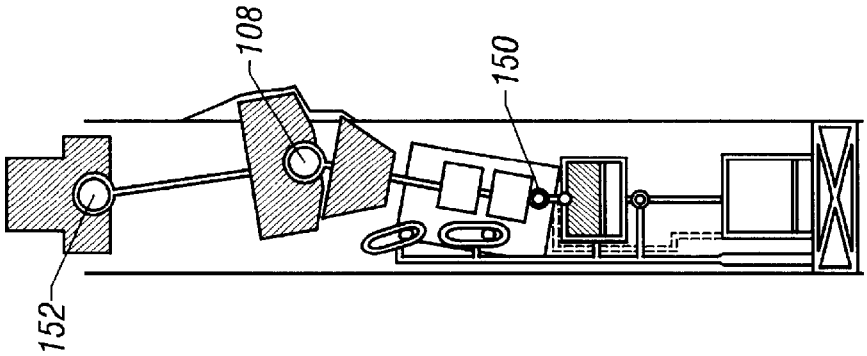
Figure 2A:
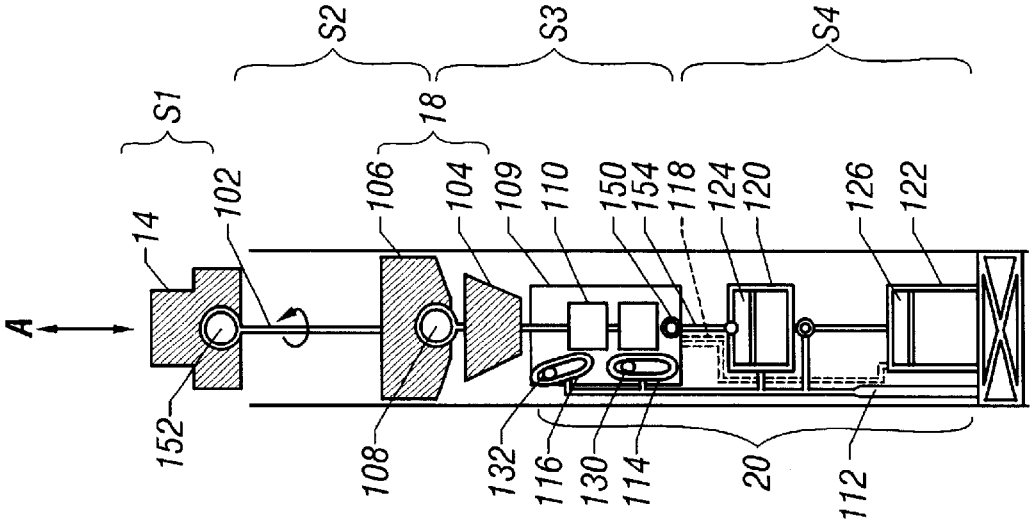

Referring to FIGS. 2A–2D, operation of the whipstock-less milling tool 12 is illustrated. The rotary generator 14 supplies rotary power to a rotatable shaft 102 that is part of the articulated assembly 16. The shaft 102 is coupled to the mill mechanism 18, which has a pilot mill 104 and a gauge mill 106. Although two mills are illustrated in the described embodiment, further embodiments may include only one mill or more than two mills. As shown in FIG. 2A, in the run-in position, the pilot mill 104 and the gauge mill 106 are substantially lined up along the longitudinal axis (indicated generally as A) of the milling tool 12. The pilot mill 104 has a diameter that is smaller than a diameter of the gauge mill 106, which in one embodiment is a full-bore mill. The diameter of the gauge mill 106 is substantially identical to the inner diameter of the liner 10 to allow milling full gauge windows. The pilot mill 104 is provided to cut a first depth into the liner 10 so that more room is provided for the deflection of the gauge mill 106, as described below. The groove created by the pilot mill 104 also helps maintain alignment of the gauge mill 106.

In one embodiment, the mills 104 and 106 are made of tungsten carbide inserts mounted on the periphery of steel bases. Other suitable materials designed to cut through a liner (or other types of downhole structures) can also be used. The grade and distribution of the cutting inserts on the periphery of each mill 104 and 106 is optimized to reduce wear due to exposure to the cement layer and surrounding formation after cutting through the liner.

A pivot 108 is provided between the pilot mill 104 and the gauge mill 106 to enable relative angular deflection between the pilot mill 104 and the gauge mill 106. In one embodiment, the pivot may be a ball joint (as discussed in connection with FIGS. 5A–5B). In another embodiment, instead of a ball joint, the pivot 108 may be a narrowed or thinned portion that is bendable (referred to as the bending joint configuration). For example, a shaft carrying the pilot and gauge mills 104 and 106 may have a bending portion that is smaller in diameter than the remainder of the shaft. If sufficient force is applied, the shaft is designed to bend at the bending portion, which forms the pivot. In yet another embodiment, a spring may be provided between different portions of the shaft, with the spring bendable to provide a pivot. The other pivots discussed herein may also be any one of the ball joint configuration, bending joint configuration, spring configuration, or another configuration.

The periphery of the gauge mill 106 cuts through the liner and reaches the cemented annulus and surrounding formation. To reduce exposure to the surrounding formation, the amplitude of deflection of the gauge mill 106 is controlled so that the cutting is concentrated on the liner and not on the surrounding formation.

Relative deflection of the pilot mill 104 and the gauge mill 106 is controlled by the deflecting and feed control unit 20, which includes a hydraulic control unit 109 having a hydraulic pump 110, a hydraulic manifold 112, a linear slot 114, and a slanted slot 116. In other embodiments, the control unit 109 can be replaced with an electrical control unit, a mechanical control unit, a pneumatic control unit, or other types of control units (which may be based on electronic controllers interfaced to either hydraulic or electric-powered devices). Alternatively, the deflecting and feed control unit 20 may be entirely passive, with the deflection and feed of the milling string being based on the average weight of the tool over a certain period of time.

As illustrated, the linear slot 114 extends along an axis that is generally parallel to the longitudinal axis A of the milling tool 12. The slanted slot 116 is at a predetermined angle with respect to the longitudinal axis A of the tool 12. As further described below, the slots 114 and 116 cooperate to control deflection of the tool 12. In other embodiments, other arrangements of the slots 114 and 116 are possible to control the angular deflection of portions of the milling tool 12. Also, a single slot may provide the desired control, as can more than two slots. Alternatively, the deflection may also be caused by a hydraulic or electromechanical actuator.

In the illustrated embodiment, the hydraulic manifold 112 is hydraulically coupled to a deflecting actuator unit 120 (that controls deflection of the milling tool 12) and a feed actuator unit 122 (that controls longitudinal movement of the mill mechanism 18). The deflecting actuator unit 120 includes a first chamber and first piston 124 movably disposed in the first chamber, and the feed actuator unit 122 includes a second chamber and a second piston 126 movably disposed in the second chamber. Hydraulic communication between the manifold 112 and the actuator units 120 and 122 over hydraulic lines 118 control movement of the pistons 124 and 126 in the corresponding chambers. The hydraulic pump 110 in the hydraulic control unit 109 can pump fluid (through the manifold 112) to an upper surface of the first piston 124 in the deflecting actuator unit 120 to start downward movement of the piston 124. This causes deflection of the assembly 12. The pump 110 can also pump fluid to an upper surface of the second piston 126 in the feed actuator unit 122 to move the piston 126 downwardly, which causes downward movement of the mill mechanism 18 and the control unit 109.

In one embodiment, the spin rate and torque supplied by the rotary generator 14 can be controlled by adjusting mud circulation parameters at the well surface. Thus, the torque on the mills 104 and 106 is controlled by fluid circulation pressure differential, while the spin rate of each mill can be controlled by the flow rate. The feed rate (longitudinal movement of the mills) is proportional to the spin rate of the shaft 102. The primary shaft spin rate can be adjusted depending on the grade and type of milling structure and the liner.

In an alternative embodiment, the controlled feed feature may be achieved by hydraulic flow control valves that limit flow across pistons in both the deflecting and feed actuator units 120 and 122. The rate of penetration is generated by action of the weight applied on the milling tool by the drill string and controlled by the flow control valves. In another alternative, a hydraulic pump system is modulated by the amount of weight applied by the drill string. Other solutions may be used for downhole feed control.

The linear slot 114 and the slanted slot 116 in the control unit 109 receive respective pins 130 and 132, which pins are capable of travelling along the respective slots 114 and 116. Downward movement of the first piston 124 causes the pins 130 and 132 to move downwardly along respective slots 114 and 116. Because of the slanted orientation of the slot 116, the milling tool 12 is deflected at various pivot points, including the pivot 108 between the pilot mill 104 and the gauge mill 106, a pivot 152 between the rotatable shaft 102 and the rotary generator 14, and a pivot 150 between the control unit 109 and a connector 154.

The kinematics model for the milling tool according to one embodiment is a four-bar linkage system, with deflectable bars (S1, S2, S3, and S4) linked at the pivots 152, 108, and 154. The upper- and lower-most bars S1 and S4 remain substantially coaxial with the liner, while the bars 53 and 54 are deflectable with respect to the bars S1 and S4.

As shown in FIG. 2B, after a predetermined number of rotations of the shaft 102, hydraulic fluid is communicated by the hydraulic control unit 109 to the upper surface of the piston 124 to cause the piston 124 in the deflecting actuator unit 120 to move downwardly to the bottom of the first chamber. As shown, the pins 130 and 132 also travel along respective slots 114 and 116, which causes the milling tool 12 to deflect at pivot points 152, 108, and 150. As the pilot mill 104 is deflected with respect to the longitudinal axis A of the milling tool, the pilot mill 104 is brought into engagement with the inner surface of the liner 10. While the deflection is occurring, the shaft 102 and mills 104 and 106 continue to rotate. The pilot mill 104 cuts through a first portion of the liner 10. After further deflection, the gauge mill 106, with a larger diameter, then engages the inner surface of the liner 10 and cuts through the liner 10.

After deflection has occurred, continued rotation of the shaft 102 causes the control unit 109 to pump hydraulic fluid to the upper surface of the piston 126 in the feed actuator unit 122. As shown in FIG. 2C, downward movement of the piston 126 in the second chamber causes the pilot mill 104 and the gauge mill 106 to travel downwardly while still being rotated by the rotating shaft 102 and in engagement with the liner 10. This causes the window to be formed in the liner 10. The length of the window is determined by the travel distance of the piston 126.

After milling has been completed, the hydraulic control unit 109 pumps fluid to the lower surface of the first piston 124 in the deflection actuator 120. This pushes the piston 124 upwardly in the first chamber, which causes the milling tool 12 to straighten from its deflected position. After the piston 124 has moved to its upward position, as shown in FIG. 2D, the milling tool 12, along with the rest of the tool string, may be retrieved from the wellbore.

Figure 3A:
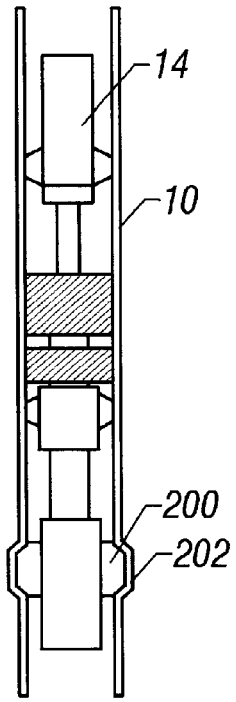
FIGS. 3A–3D illustrate milling and drilling operations according to an embodiment.
Figure 3B:
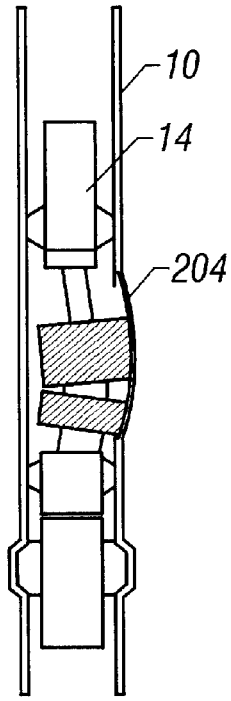
Figure 3C:
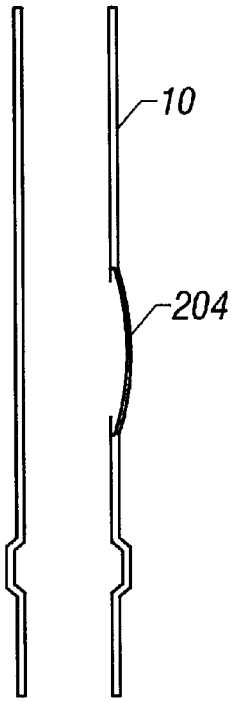
Figure 3D:
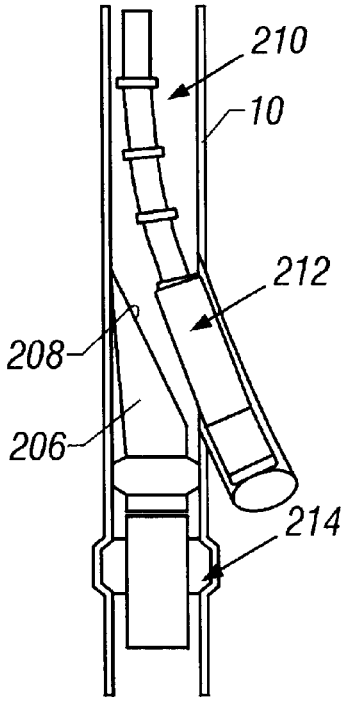

Referring to FIGS. 3A–3D, a method of milling a window in a liner and drilling a lateral bore is illustrated. In FIG. 3A, the milling tool 12 is lowered to a desired position in the wellbore. In the embodiment shown in FIG. 3A, the landing and latching device 22 includes keys 200 that can be mated to corresponding profiles in the liner 10. After setting the milling tool 12, the rotary generator 14 is started, and the pilot and gauge mills 104 and 106 are deflected and moved downwardly to create a window 204 in the liner 10, as shown in FIG. 3B. As shown in FIG. 3C, after the milling operation is complete, the milling tool 12 is straightened up and removed from the wellbore, leaving behind the window 204 milled through the liner 10. Next, a drilling deflector, which may be a whipstock 206, is set in the wellbore proximal the window 204. The whipstock 206 includes landing and orienting keys 214 similar to the ones used with the milling tool 12. The whipstock 206 provides a deflecting surface 208 to direct a drill string 210 having an adjustable bent sub drilling motor 212 that is capable of drilling through the formation adjacent the window 204.

Figure 4A:
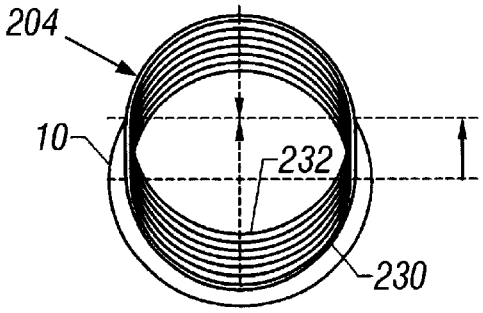
FIGS. 4A–4B illustrate deflection of a mill in the milling tool of FIG. 1 and formation of a window and side pocket in a liner using the milling tool of FIG. 1.
Figure 4B:
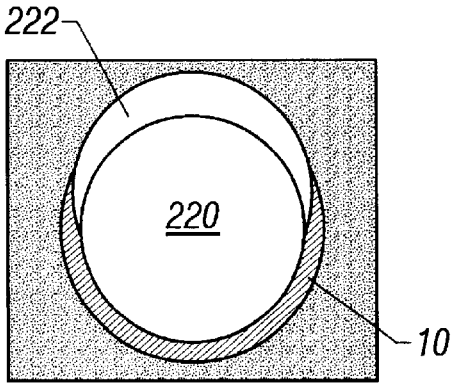

Referring further to FIG. 4A, deflection of the gauge mill 106 is illustrated. The gauge mill 106 starts from its initial position (curve 230) inside the bore of the liner 10. The gauge mill 206 moves gradually in an outward radial direction, indicated generally as R, until it reaches an outermost radial position (curve 232). As shown in FIG. 4B, the bore of the liner 10 is indicated by the reference numeral 220, while the window and side pocket formed by the gauge mill 106 is indicated by the reference numeral 222.

Figure 5A:
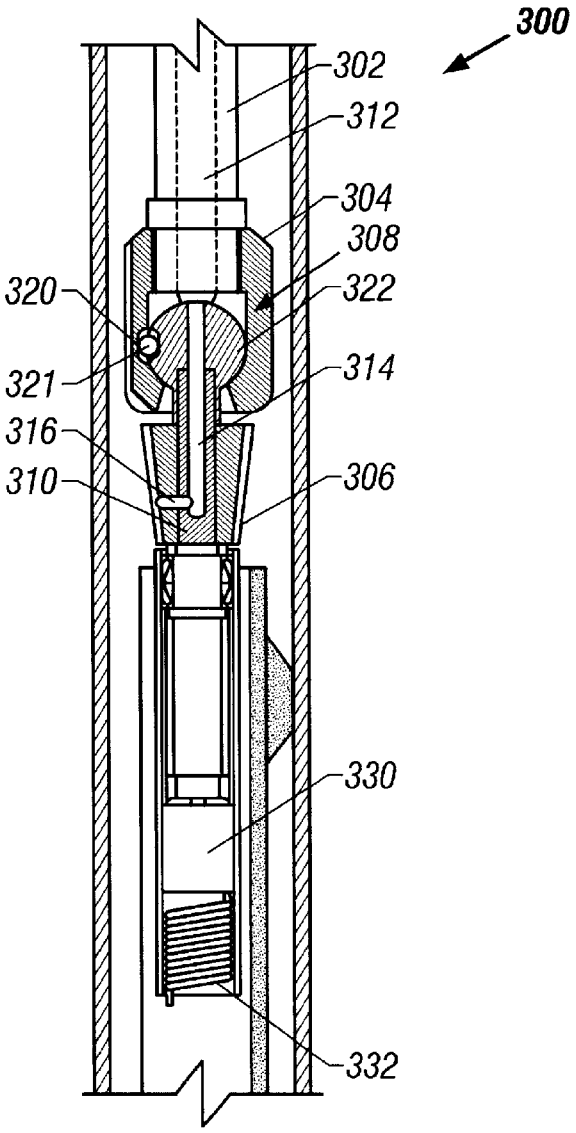
FIGS. 5A–5B are sectional views of an embodiment of a milling tool.
Figure 5B:
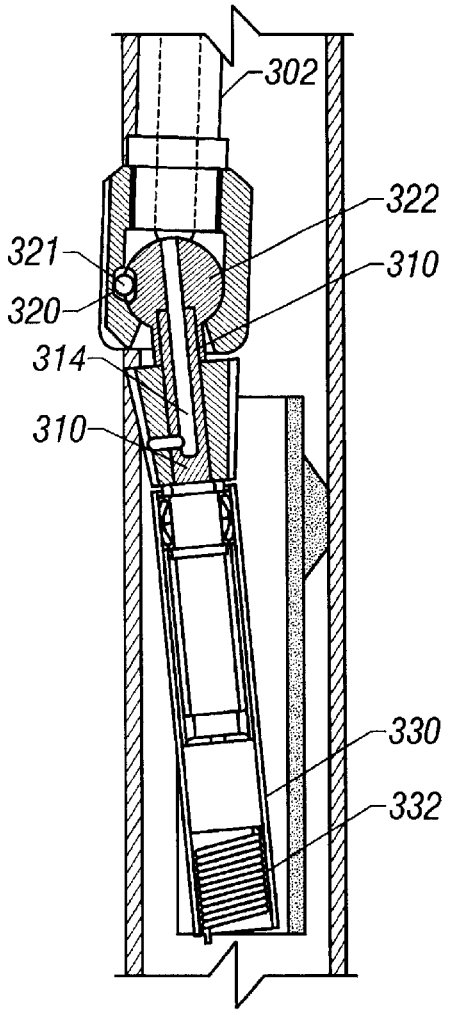

Referring to FIGS. 5A–5B, an embodiment of a whipstock-less milling tool 300 similar to the embodiment of FIGS. 1 and 2A–2D is illustrated in greater detail. The milling tool 300 has a rotatable primary shaft 302 that is rotatably driven either by a downhole rotary generator or by a rotary force supply from the well surface. The milling tool 300 also has a pilot mill 306 and a gauge mill 304. The lower end of the rotatable shaft is received inside the gauge mill 304, which also contains a ball joint 308. The ball joint 308 is designed to transmit rotating power to a secondary shaft 310 below the ball joint 308. In addition, the ball joint 308 transmits an axial load resulting from action on the upper drill string as well as transmits a radial force to help the mills 304 and 306 penetrate the wall of the liner. The ball joint 308 also enables misalignment between the primary shaft 302 and the secondary shaft 310, while still transmitting a rotary force to rotate the pilot mill 306.

The ball joint 308 includes a generally spherical universal joint element 322 that is received inside the receptacle of the gauge mill 304. The ball joint 308 also provides ball receptacle segments 320 adjacent the spherical joint element 322, with each ball receptacle 320 capable of receiving a torque-transmitting ball 321. The ball receptacles 320 are of greater dimension than the dimension of the torque-transmitting balls 321 to permit pivotal articulation of the pilot mill 306 relative to the primary shaft 302. The cooperation of the ball receptacles 320 and the torque transmitting balls 321 permit a predetermined inclination of the pilot mill 306 with respect to the shaft 302.

As discussed above, instead of a ball joint, such as ball joint 308 in FIG. 5B, a bending joint may be employed to provide a pivot.

As further shown in FIG. 5A, a fluid circulation path 314 is provided inside the secondary shaft 310, and an inner bore 312 is provided inside the primary shaft 302. A slot 316 enables communication between the secondary shaft inner bore 314 and the outside of the pilot mill 306. Thus, as the pilot mill is grinding into the surrounding liner 10, circulation fluid directs milling cuttings through the slot 316, inner bore 314 of the secondary shaft 310, and the inner bore 312 of the primary shaft 306 for transport to the well surface.

The milling tool 300 also includes a hydraulic module 330, which is similar to the hydraulic control unit 109 discussed in connection with FIGS. 2A–2D. The hydraulic module 330 is coupled by hydraulic lines 332 to actuator units (not shown) that are similar to the deflecting actuator unit 120 and the feed actuator unit 122 of FIGS. 2A–2D.

The whipstock-less milling tool in accordance with some embodiments provides a convenient and efficient method and apparatus of forming windows in liners to either change the trajectory of a wellbore, to add a lateral branch, or to create a side cavity in the wellbore. The milling operation can be performed in a single run, since the separate steps of setting a milling whipstock and retrieving the milling whipstock are avoided. Superior control of the geometry of the liner window is also provided with the milling tool, since the unpredictable interaction between a whipstock and a mill is avoided. The milling tool can be used in different types of wellbores, including vertical wellbores, deviated wellbores, or horizontal wellbores.

Thus, generally, the whiptock-less milling tool has a support with an anchor fixing the position of the support in the well. The support has at least one mill thereon positioned above the anchor. The support also defines a travel path for the at least one mill, with the travel path offset from a predetermined axis to enable the milling of a downhole structure. If the downhole structure is a conduit having an axis, then the travel path of the mill can be offset from the conduit axis.

Figure 6:
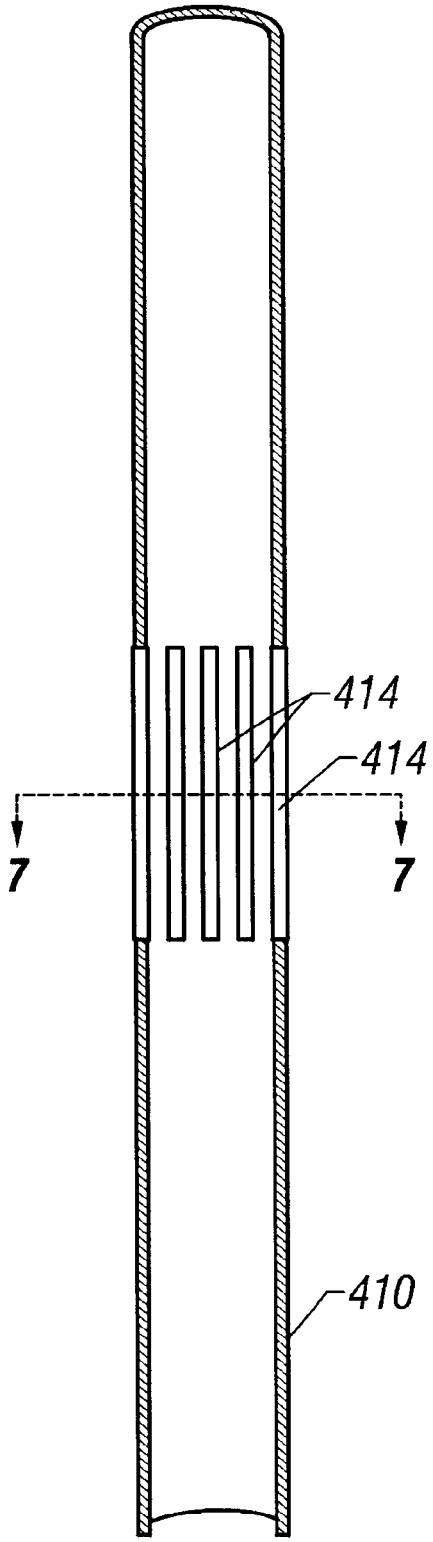
FIG. 6 illustrates a liner having axial slots formed therein in accordance with an embodiment.
Figure 7:
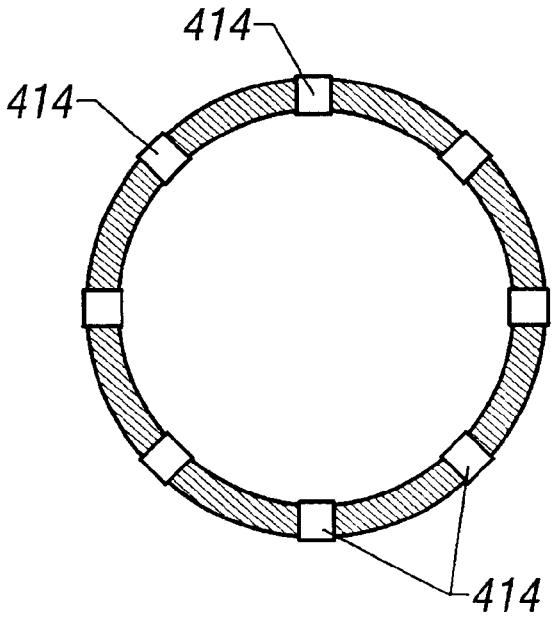
FIG. 7 is a cross-sectional view of a portion of the slotted liner of FIG. 6.

In addition to forming windows in liners to enable a change of a wellbore trajectory or to add a lateral branch, milling tools according to further embodiments can be used for other applications. One such other application is the formation of axial slots along the liner to enable propagation of EM signals through the liner to enable measurement of characteristics of the surrounding formation. Referring to FIGS. 6 and 7, slots 414 are formed along the longitudinal axis of a liner 410 using a whipstock-less milling tool in accordance with an embodiment. The mills used in the milling tool to form the axial slots are smaller than the pilot or gauge mills used in the milling tools shown in FIGS. 1–5. As shown in FIG. 7, eight axial slots are formed along the circumference of the liner 410. In further embodiments, a smaller or greater number of slots may be formed.

The slots 414 permit propagation of EM radiation from a source within the liner 410 into the formation surrounding the liner 410. The type of EM radiation that is permitted through the slots 414 includes transverse electric (TE) mode radiation. The slots 414 are designed to block transverse magnetic (TM) radiation.

Figure 8:
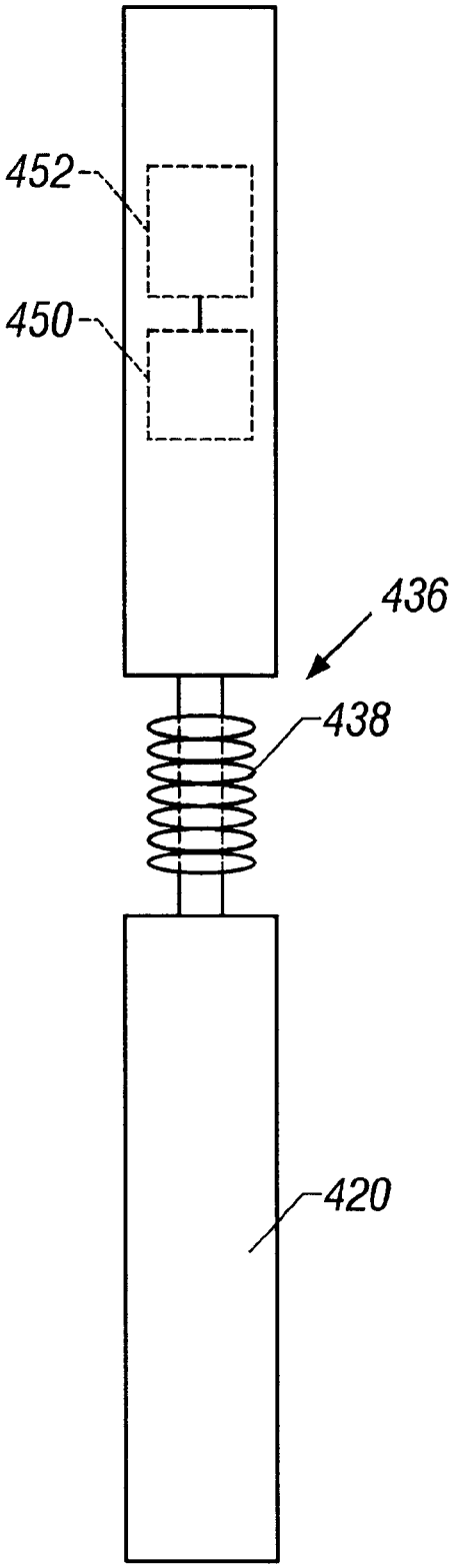
FIGS. 8–9 illustrate a monitoring tool useable with the slotted liner of FIG. 6 to take measurements of the surrounding formation.

Referring further to FIG. 8, an elongated monitoring tool 436 can be run inside the liner 410 to a position proximal the slots 414 shown in FIG. 6. The monitoring tool 436 includes a housing 420 that contains one or more multi-turn coil antennas 438 as known in the art. The antennas 438 transmit and/or receive EM energy including azimuthal, radial, or axial field components. As further shown in FIG. 9, a metal shield 440 with slots 442 surrounds each antenna 438 to protect the antennas 438 from external damage.

Also contained within the housing 420 of the monitoring tool 436 are one or more sensors 450 and other electronic circuitry 452, including a downhole processor, a storage device, or a downhole power source. The power source may include a local battery or turbine, or alternatively, the power source may include circuitry to receive power delivered over an electrical cable from the well surface.

Figure 10:
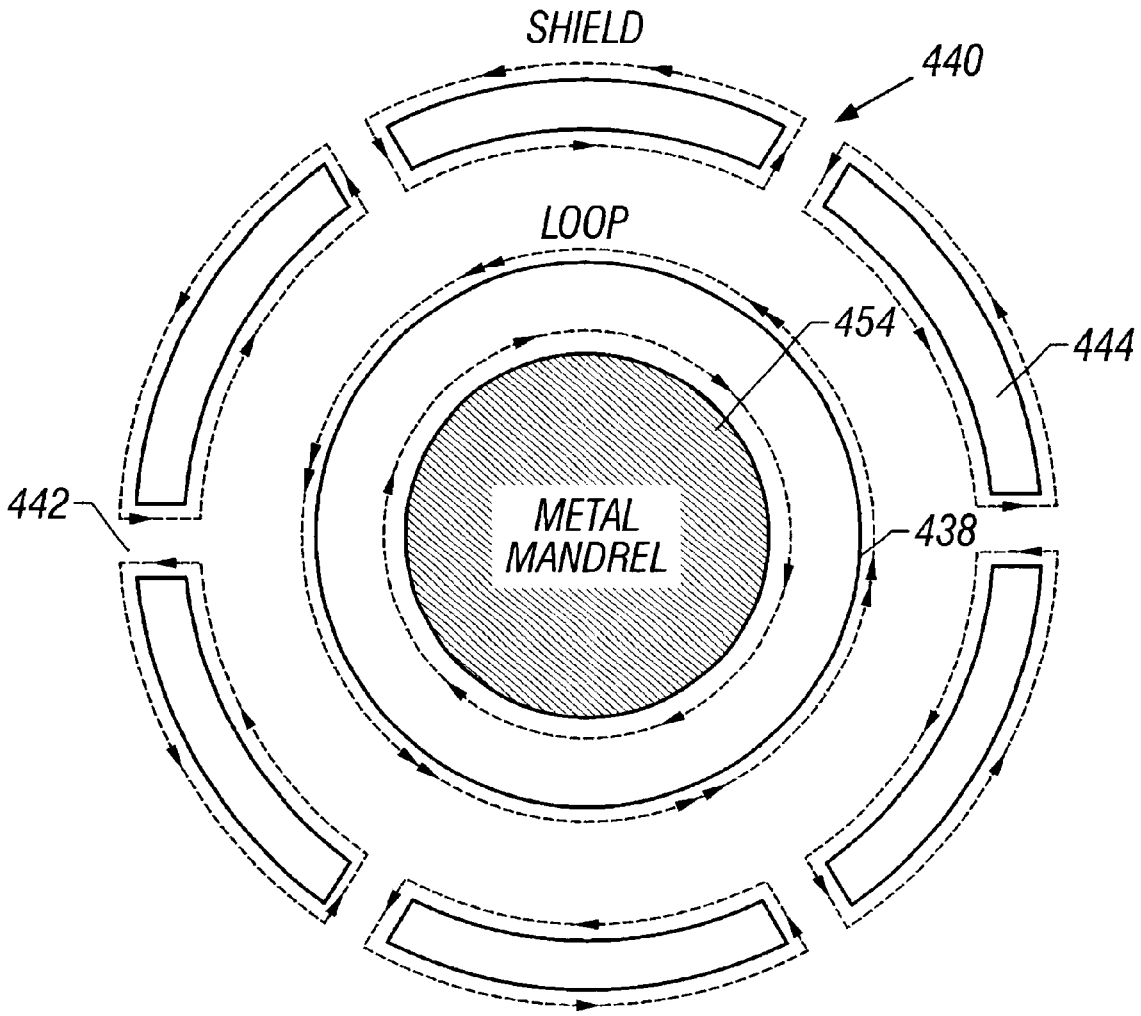
FIG. 10 illustrates the electromagnetic interaction between a coil antenna and shield assembly in the monitoring tool of FIGS. 8–9.

The coil antennas 438 generate TE-polarized EM waves that are communicated through slots 442 in the housing of the monitoring tool 436 and slots 414 of the liner 410. Referring further to FIG. 10, the operating principle of the antennas 438 and shield 440 is illustrated. A transmitting antenna 438 is energized to carry the transmission current (represented by a double arrow) and create an azimuthally polarized electric field. This field induces a current (represented by a single arrow) in a central middle mandrel 454 of the monitoring tool 436 and on the inside of each shield blade 444 between slots 442 of the shield 440.

The current induced in each shield blade 444 flows to the edge of the blade, where it cannot continue azimuthally but instead flows around an edge to the outside of the shield 440 and closes its loop on the outer blade surface. Thus, the outside of the shield 440 carries an effective current loop. The shield 440 is preferably radially thicker than about two skin depths to minimize any interference of the induced current flowing on the inside and the outside of the shield 440. Azimuthally, the slots 442 are thinner than the width of the shield blade 444. One single slot 442 is sufficient to reliably filter the azimuthal wave.

At a receiving antenna 438, the process is reversed. The arriving (azimuthally or TE polarized) EM wave induces an azimuthal current on the outside of the shield 440. At the edge of each shield blade 444, the current flows around to the inside of the blade 444 where it closes the loop. Together, the shield blades 444 carry (on the inside) an approximately closed current loop that induces a current in the receiving antenna 438. This current signal is then processed and/or stored by the electronic downhole or sent to a surface via a wireline cable. Any axial or radial component of the EM wave is short-circuited at the axial ends of shield 440 into the middle mandrel 454 body, thus eliminating parasitic signals.

Figure 9:
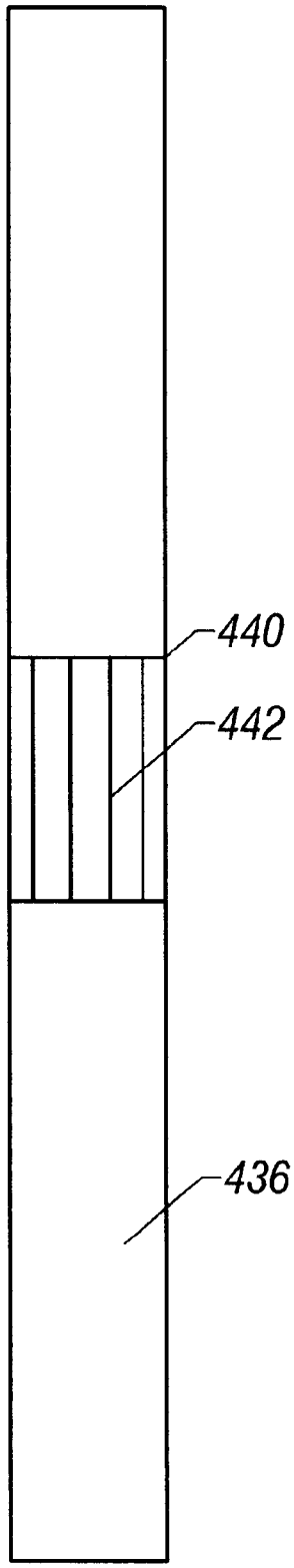
Figure 11A:
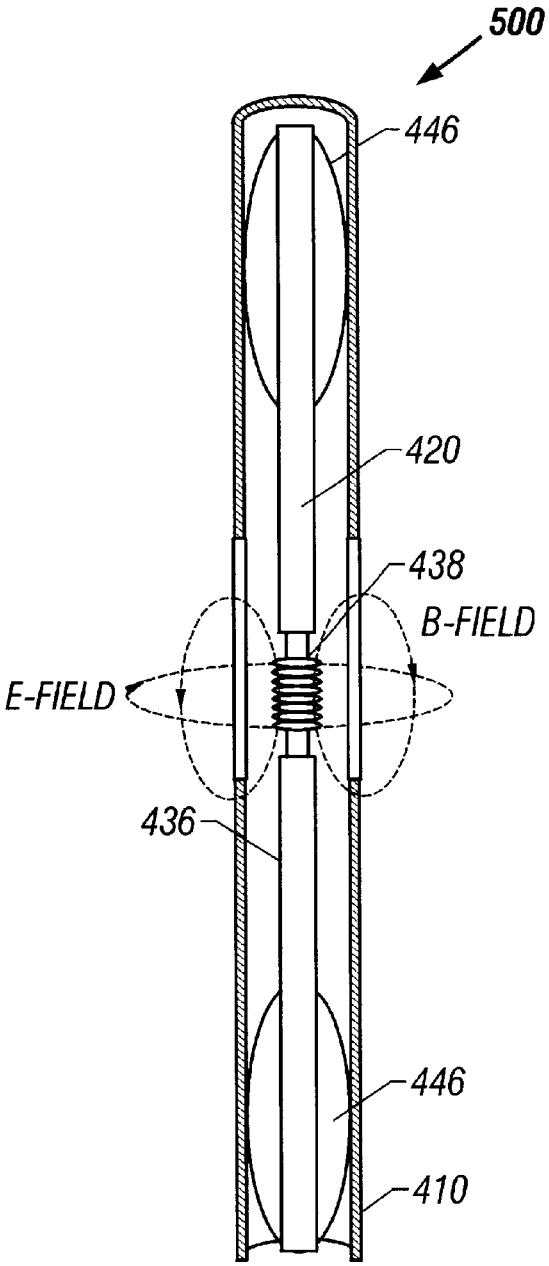
FIG. 11A illustrates a sensor system containing the monitoring tool of FIGS. 8–9 placed inside the slotted liner of FIG. 6.
Figure 11B:
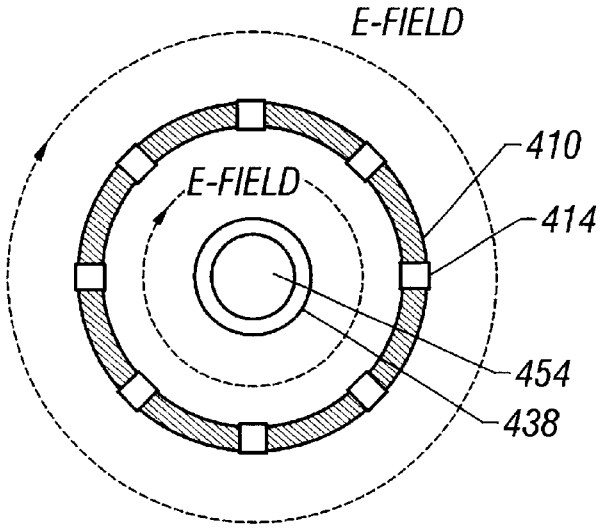
FIG. 11B illustrates the electromagnetic interaction between the sensor system and slotted liner.

Referring to FIGS. 11A and 11B, a sensor system 500 is disposed within the liner 410. The system 500 includes the monitoring tool 436 as shown in FIGS. 8 and 9. In one embodiment, the system 500 also includes bow springs 446 affixed to the mandrel 454 body to centralize the monitoring tool 436 within the liner 410. In further embodiments, other mechanisms for centralizing and fixing the system 500 within the wellbore may be employed. In addition to direct deployment within the liner 410, the system 500 may be hung below tubing, deployed through tubing, or integrated with tubing within the liner 10. The antennas 438 of the monitoring tool 436 are positioned proximal the slots 414 of the liner 410.

With the system 500 disposed in the liner 410, the EM waves generated by transmitting antennas 438 couple to the slotted portion of the liner 410 in the same way as to the slotted shield 440. The azimuthal electric field component dominates the signal and induces a current on the inside of the liner 410, as shown in FIG. 11B. At each liner slot 414, the current flows around the edge to the outside and azimuthally closes the current loop on the outside of the liner 410. From there, the EM wave is radiated off into the surrounding formation as in an open-hole logging operation.

Figure 12A:
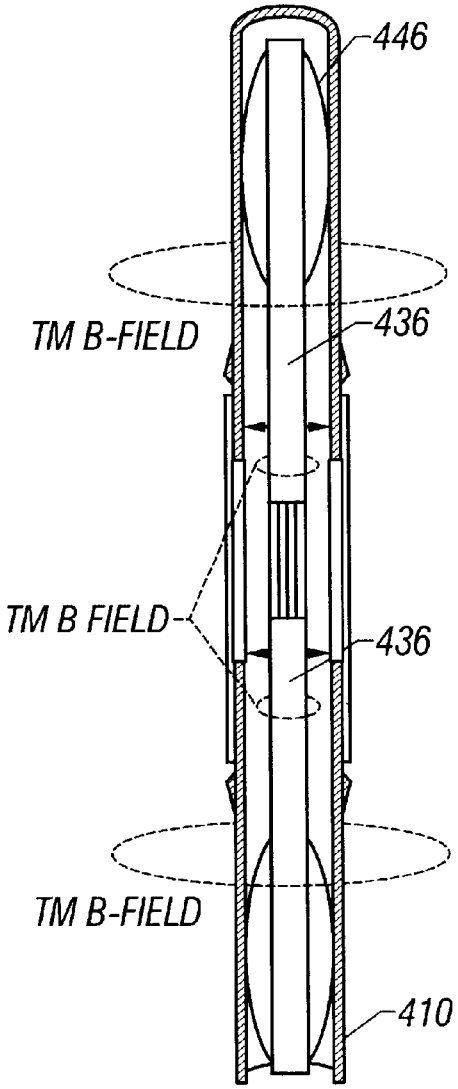
FIGS. 12A–12B illustrate distribution of transverse magnetic waves with the sensor system and slotted liner of FIGS. 11A–11B.
Figure 12B:
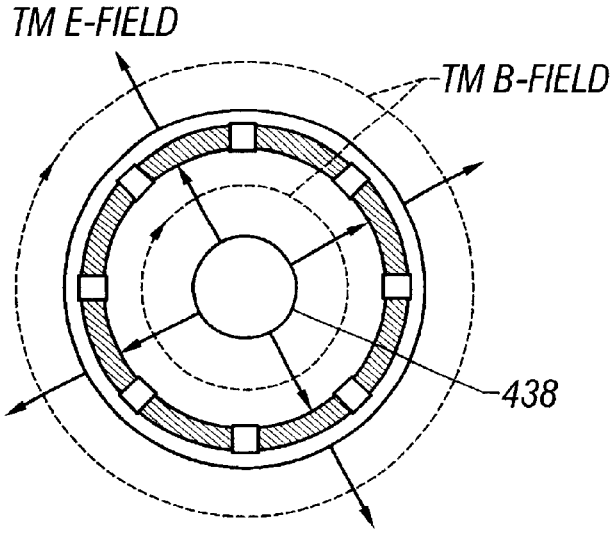

Inside the liner 410, the housing 420 of the monitoring tool 436 and the liner 410 itself provides a low attenuation path for TM waves. TM waves have (mostly) radial electric fields and azimuthal magnetic fields, as indicated in FIGS. 12A and 12B. These TM waves can interfere with resistivity measurements if no steps are taken to suppress their effects. In addition to centralizing the monitoring tool 436, the bow springs 446 also provide an electrical conductive path, providing a short between the housing of the monitoring tool 436 and the liner 410, which attenuates the TM waves. As described above, the antenna shields 440 also provide a degree of isolation against the TM waves.

TM waves can also be present on the outside of the liner 410 due to TE-to-TM conversion at dipping beds. As the steel in the liner 410 has a conductivity many orders of magnitude higher than any formation, such TM electrical currents can concentrate on the liner 410. However, the axial slots 414 in the liner 410 also function as an EM shield and do not permit TM fields on the outside of the liner 410 to penetrate inside the liner 410.

Other embodiments of the sensor system 500 can also be used. For example, a system having an inner bore for fluid communication can be provided so that sensors are arranged on the outside of the inner bore while production fluid can flow through the bore of the sensor system 500 to the well surface.

Figure 13:
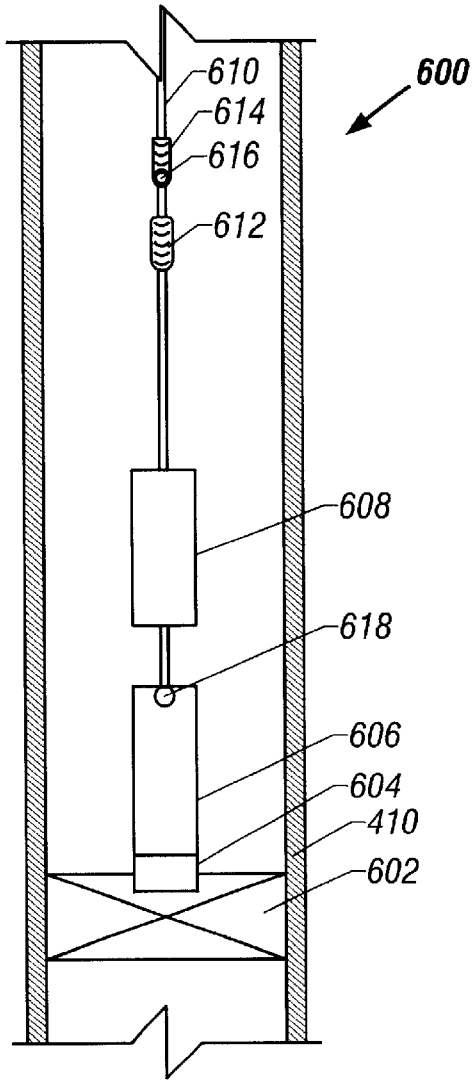
FIG. 13 illustrates a milling tool for forming the axial slots of the liner of FIG. 6, in accordance with an embodiment.

Referring to FIG. 13, a milling tool 600 for forming the desired axial slots 414 in the liner 410 is illustrated. The milling tool 600 includes an anchoring device 602 that includes keys for mating with corresponding profiles in the liner 410 to set the milling tool 600 at the desired depth as well as to orient the milling tool in the desired azimuthal orientation. As in the case of the milling tool 12 of FIGS. 1 and 2A–2D, the milling tool 600 includes a hydraulic control unit 608 that is connected to deflections and feed module 606 having a deflecting actuator unit and a feed actuator unit. The module 606 is rotatably connected to the anchor device 602 by a connector 604. The connector 604 can be set in a number of different positions that correspond to the azimuthal locations of the desired axial slots 414. Thus, when the milling tool 600 is initially set in the wellbore, it has a first azimuthal position to enable the milling tool 600 to form a first axial slot. By rotating the connector, the milling tool 600 is then rotated with respect to the anchor device 602 to the second azimuthal position to form the second axial slot 414. This is repeated for each successive axial slot.

The milling tool 600 also includes a first mill 612 and a second mill 614 with the diameters of the mills 612 and 614 selected to form slots 414 of a predetermined width. A pivot 616 provided between the first and second mills 612 and 614 to enable relative deflection between the mills. The second mill 614 is coupled to a rotatable shaft 610 that is driven by a rotary generator, located either downhole or at the well surface. When spinning of the shaft 610 is started, the deflecting actuator unit in the module 606 causes relative deflection of the milling tool 600, including at pivots 616 and 618. This causes the first mill 612 to engage the liner 410 to carve a first portion of the liner. The second mill 614 then engages the liner to cut through the liner 410. Further spinning of the shaft 610 causes the feed actuator unit in the actuator module 606 to cause downward movement of the mills 612 and 614. The amount of displacement controlled by the feed actuator unit provides the desired length of the axial slot 414 formed in the liner 410.

After the desired axial slots 414 have been formed in the liner 410, the milling tool 600 is retrieved from the wellbore. Next, a sensor system, such as system 500 in FIG. 11A, is run into the wellbore and positioned proximal the slots 414. Measurements are then taken of the surrounding formation by inducing the propagation of EM waves into the formation. One type of measurements taken in the measurement of electrical resistivity near the wellbore to determine production zones in oil and gas fields and to map sand and shale layers. Electrical resistivity depends directly on porosity, fluid resistivity, and saturation. Porous formations having a high resistivity generally indicate the presence of hydrocarbons while low resisting formations are general water saturated.

Figure 14:
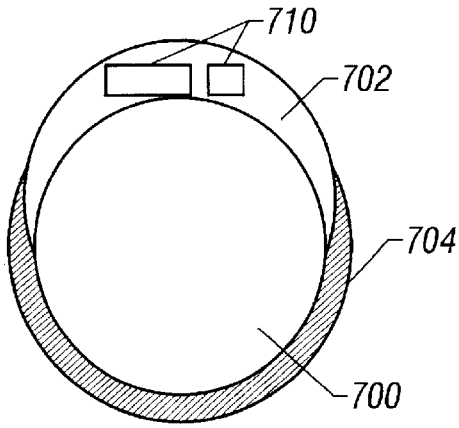
FIG. 14 illustrates placement of monitoring and control devices, including sensors, in the side pocket of a liner formed by a milling tool of an embodiment of the invention.

Referring to FIG. 14, in accordance with another embodiment, monitoring and control devices 710 can be positioned in a side pocket or window 702 formed in a liner 704. The side pocket 702 is formed with a whipstock-less milling tool according to an embodiment. Due to the superior control of the window geometry using the whipstock-less tool, accurate placement of the monitoring and/or control devices 710 can be achieved.

In operation, a whipstock-less milling tool can be run into the bore 700 of the liner 704 to a desired depth. The milling tool is then activated to cut the side pocket 702. After removal of the milling tool, a running tool carrying a module containing the monitoring and/or control sensors 710 can be run into the wellbore and placed in the side pocket 702. The running tool can then be detached from the module, leaving the monitoring and/or control devices behind in the side pocket 702. Monitoring devices can be used to take measurements of the surrounding formation. Examples of monitoring devices include pressure gauges, temperature sensors, electromagnetic sensors, acoustic transmitters/receivers, seismic detectors, and so forth.

While the invention has been disclosed with respect to a limited number of embodiments, those skilled in the art will appreciate numerous modifications and variations therefrom. It is intended that the appended claims cover such modifications and variations as fall within the true spirit and scope of the invention. For example, although the described embodiments refer to hydrocarbon-producing wells, further embodiments may be applied to other types of wells, such as water wells.

What is claimed is:

1. A milling tool for use in a well having a conduit, the conduit having an axis, the tool comprising:

a support having an anchor fixing the position of the support in the well;

the support having at least one mill thereon positioned above the anchor, the support having a first support portion, a second support portion, and a pivot coupling the first and second support portions;

the first and second support portions bendable with respect to each other at the pivot to define a travel path for the at least one mill, with the travel path offset from the axis of the conduit.

2. A milling string for use in a wellbore having a first structure, comprising:

a support assembly having a first end and a second end;

at least one mill supported by the support assembly between the first and second ends; and a deflection apparatus having an actuator unit attached to the support assembly to bend one portion of the support assembly with respect to another portion of the support assembly to deflect the at least one mill to engage the first structure to form an opening in the first structure.

3. The milling string of claim 2, wherein the support assembly comprises a rotatable shaft connected to the at least one mill.

4. The milling string of claim 2, wherein the at least one mill comprises a pilot mill having a first diameter, the milling string further comprising a second mill having a second, larger diameter.

5. The milling string of claim 4, wherein the first structure comprises a generally tubular structure having an inner diameter, wherein the second diameter is substantially the same as or greater than the tubular structure inner diameter.

6. The milling string of claim 2, wherein the first structure comprises a generally tubular structure.

7. The milling string of claim 2, wherein the first structure comprises a generally tubular structure, and wherein the at least one mill is adapted to form one or more axial slots along the generally tubular structure.

8. The milling string of claim 7, further comprising a connector coupled to the at least one mill, the connector rotatable to enable the at least one mill to form plural axial slots along the circumference of the tubular structure.

9. The milling string of claim 2, wherein the deflection apparatus is adapted to deflect the at least one mill from a longitudinal axis of the milling string.

10. The milling string of claim 2, comprising at least two mills that are deflectable with respect to each other.

11. The milling string of claim 2, comprising at least two portions, wherein one of the two portions contains the at least one mill, and wherein the at least one mill is deflectable with respect to the other portion.

12. A milling string for use in a wellbore having a first structure, comprising:

a support assembly having a first end and a second end;

at least one mill supported by the support assembly between the first and second ends; and a deflection apparatus attached to the support assembly to deflect the at least one mill to engage the first structure to form an opening in the first structure, wherein the deflection apparatus is powered by rotation of the shaft.

13. A milling string for use in a wellbore having a first structure, comprising:

a support assembly having a first end and a second end;

at least one mill supported by the support assembly between the first and second ends; and a deflection apparatus attached to the support assembly to deflect the at least one mill to engage the first structure to form an opening in the first structure, wherein the deflection apparatus comprises a hydraulic actuator unit including a longitudinally moveable first piston.

14. The milling first string of claim 13, wherein the first piston is moveable to deflect the at least one mill into engagement with the first structure.

15. A milling string for use in a wellbore having a first structure, comprising:

a support assembly having a first end and a second end;

at least one mill supported by the support assembly between the first and second ends;

a deflection apparatus attached to the support assembly to deflect the at least one mill to engage the first structure to form an opening in the first structure; and a feed actuator unit adapted to move the at least one mill longitudinally after engagement with the first structure.

16. The milling string of claim 15, wherein the feed actuator unit is hydraulically actuatable.

17. The milling string of claim 16, further comprising a pump system to communicate hydraulic pressure to the feed actuator unit.

18. A method for use in a wellbore lined with a liner, comprising:

running a milling tool having at least one mill into the wellbore, the at least one mill mounted on a support assembly having a first portion and a second portion coupled by a pivot;

deflecting the first and second portions to bend the first and second portions at the pivot with respect to each other so that the at least one mill engages the liner; and rotating the at least one mill to form an opening in the liner.

19. The method of claim 18, wherein deflecting the first and second portions comprises rotating a rotatable shaft and moving a piston in a deflecting actuator unit in response to rotation of the shaft.

20. The method of claim 19, wherein deflecting the first and second portions further comprises actuating a hydraulic control unit by rotation of the shaft, the hydraulic control unit delivering hydraulic pressure to move the piston.

21. A method for use in a wellbore lined with a liner, comprising:

running a milling tool having at least one mill into the wellbore;

deflecting at least two portions of the milling tool with respect to each other so that the at least one mill engages the liner;

rotating the at least one mill to form an opening in the liner; and longitudinally moving the at least one mill to cut an opening having a predetermined length.

22. The method of claim 21, wherein moving the at least one mill comprises rotating a rotatable shaft and moving a member in a feed actuator unit in response to rotation of the shaft.

23. The method of claim 22, wherein moving the at least one mill further comprises actuating a control unit by rotation of the shaft, the control unit delivering power to move the member in the feed actuator unit.

24. The method of claim 22, further comprising controlling a spin rate of the shaft to control the rate of movement of the at least one mill.

25. A method for use in a wellbore lined with a liner, comprising:

running a milling tool having at least one mill into the wellbore;

deflecting at least two portions of the milling tool with respect to each other;

cutting at least one slot in the liner with the at least one mill; and propagating electromagnetic waves through the at least one slot to make measurements in a formation proximal the liner.

26. The method of claim 25, further comprising cutting at least another slot in the liner.

27. The method of claim 25, further comprising running a monitoring tool having one or more sensors and one or more antennas into the liner.

28. The method of claim 25, further comprising receiving electromagnetic signals from the formation.

29. A method for use in a wellbore, comprising forming a side pocket in a liner with a whipstock-less milling tool; and placing one or more monitoring devices in the side pocket.

30. The method of claim 29, further comprising measuring characteristics of a formation proximal the side pocket with the one or more monitoring devices.

31. A milling tool for use in a wellbore having a conduit therein, the tool comprising:

a support member in the conduit;

a shaft supported by the support member such that the axial position of the shaft is fixed by the support member;

at least one mill mounted on the shaft;

an actuator attached to selectively rotate the shaft;

the support member, shaft, and mills comprising a string;

at least one pivot point in the string, the at least one pivot point allowing rotational movement of the string;

the string selectively rotatable between a run-in position and a deflected position in which the at least one mill is positioned for milling the conduit; and a control unit attached to the at least one mill having a feed unit adapted to axially move the at least one mill during milling.

32. A milling tool for milling a tubular structure in a well, comprising:

a shaft having a support that may be set in the tubular structure;

a mill on the shaft movable longitudinally relative to the support; and a connector coupled to the mill, the connector rotatable to enable the mill to form plural axial slots along the circumference of the tubular structure.

33. A milling tool for milling a conduit in a well, comprising:

a shaft having a support that may be set in the conduit; and a mill on the shaft movable longitudinally relative to the support, wherein the shaft is adapted to bend in a predetermined orientation, and the mill is rotatably mounted on the shaft.

34. The tool of claim 33, wherein the shaft is rotatable, wherein the support comprises an anchor, the tool further comprising a feed unit providing longitudinal displacement of the mill relative to the anchor.

35. The tool of claim 33, wherein the mill is above the support.

36. A milling tool for milling a conduit in a well, comprising:

a shaft having a support that may be set in the conduit; and a mill on the shaft movable longitudinally relative to the support, wherein the mill is below the support.

37. Equipment for use in a wellbore, comprising:

a conduit positioned in the wellbore;

a milling string having at least a first portion and a second portion deflectable with respect to each other, at least one mill attached to the first portion, the milling string adapted to engage the at least one mill to the conduit to form an opening in the conduit by deflecting the first and second portions; and another mill attached to the second portion.

38. The equipment of claim 37, wherein the two mills have different sizes.

* * * * *

UNITED STATES PATENT AND TRADEMARK OFFICE

CERTIFICATE OF CORRECTION

PATENT NO. : 6,474,415 B1
DATED : November 5, 2002
INVENTOR(S) : Herve Ohmer

It is certified that error appears in the above-identified patent and that said Letters Patent is hereby corrected as shown below:

Title page,
Item [73], Assignee, delete “Sugarland”, and insert -- Sugar Land --.

Column 8,
Line 42, delete “whiptock-less”, and insert -- whipstock-less --.

Signed and Sealed this

Seventh Day of September, 2004

JON W. DUDAS
*Director of the United States Patent and Trademark Office*